US006096465A

United States Patent [19]

Kadokura et al.

[11] Patent Number: 6,096,465

[45] Date of Patent: Aug. 1, 2000

[54] TONER FOR DEVELOPING ELECTROSTATIC LATENT IMAGE, METHOD FOR MANUFACTURING THE SAME, DEVELOPER AND METHOD FOR FORMING IMAGE

[75] Inventors: Yasuo Kadokura; Hisae Ishikawa; Shuji Sato; Masaaki Suwabe; Yasuo Matsumura, all of Minamiashigara, Japan

[73] Assignee: Fuji Xerox Co., Ltd., Tokyo, Japan

[21] Appl. No.: 09/421,113

[22] Filed: Oct. 19, 1999

[30] Foreign Application Priority Data

Dec. 4, 1998 [JP] Japan ..... 10-345302

[51] Int. Cl.[7] ..... G03G 9/09

[52] U.S. Cl. ..... 430/106; 430/111; 430/137

[58] Field of Search ..... 430/106, 111, 430/137

[56] References Cited

U.S. PATENT DOCUMENTS

| | | | |
|---|---|---|---|
| 5,306,589 | 4/1994 | Yamamoto et al. | 430/111 |
| 5,314,773 | 5/1994 | Kubo et al. | 430/106 |
| 5,346,797 | 9/1994 | Kmiecik-Lawrynowicz et al. | 430/137 |
| 5,391,456 | 2/1995 | Patel et al. | 430/137 |
| 5,429,898 | 7/1995 | Sugizaki et al. | 430/106 |

FOREIGN PATENT DOCUMENTS

| | | | |
|---|---|---|---|
| 63-282752 | 11/1988 | Japan . | |
| 2-144552 | 6/1990 | Japan | 430/106 |
| 6-250439 | 9/1994 | Japan . | |
| 10-26842 | 1/1998 | Japan . | |

*Primary Examiner*—Roland Martin
*Attorney, Agent, or Firm*—Oliff & Berridge, PLC

[57] ABSTRACT

A toner composed of binder resin and carbon black particles has a volume-average particle diameter ($D_{50}$) of 2.0 to 9.0 microns and a volume-average particle size distribution index (GSDv) of 1.25 or less. Carbon black particles adhering to the surfaces of toner particles have an absorption of 0.250 or less for ultraviolet radiation having a wavelength of 600 nm. Disclosed also are a method for producing the toner, a developer for developing an electrostatic latent image and a method in which the developer is used for forming animage.

21 Claims, No Drawings

TONER FOR DEVELOPING ELECTROSTATIC LATENT IMAGE, METHOD FOR MANUFACTURING THE SAME, DEVELOPER AND METHOD FOR FORMING IMAGE

BACKGROUND OF THE INVENTION

1. Field of the Invention

This invention relates to a toner used for developing an electrostatic latent image in electrophotography or electrostatic recording, a method for producing such a toner, a developer for developing an electrostatic latent image and a method for forming an image by employing such a developer.

2. Description of the Related Art

The dry developers used in electrophotography, etc. are classified into two main types: a one-component developer composed solely of a toner produced by dispersing a coloring agent in a binder resin, and a two-component one composed of a toner and a carrier. It is important for the developing agent to be excellent in flowability, transportability, fixability, chargeability and transferability in order to be suitable for use in a developing process. The toner particles contained in the developer are usually produced by a mixing and pulverizing process. This process, however, gives only a toner having an irregular particle shape and an undesirably broad particle size distribution.

A process including emulsion polymerization and cohesion has been proposed for producing a toner having a controlled particle shape and a controlled particle size distribution (Japanese Patent Applications Laid-Open Nos. 63-282752 (1988) and 6-250439 (1994)). According to this process, dispersion of resin particles is produced by emulsion polymerization, while dispersion of a coloring agent is produced by dispersing it in a solvent, these dispersion are mixed to form cohering particles having a diameter corresponding to that of toner particles, and the cohering particles are melted and united by heating to form toner particles. This process can advantageously form toner particles having any desired shape from irregular to spherical if an appropriately selected heating temperature is employed.

In connection with the above process including emulsion polymerization, we, the inventors of this invention, have proposed the addition of dispersion of resin particles as divided in a plurality of portions so that resin particles may adhere to the surfaces of cohering particles containing a mold release agent, etc. to form outermost resin layers to thereby prevent the mold release agent from being exposed on the surfaces of toner particles and make a toner having an improved powder property (Japanese Patent Application Laid-Open No. 10-26842 (1998)). It has, however, been impossible to incorporate all of the coloring agent in its dispersion into cohering particles and avoid the presence of any free coloring agent remaining in its dispersion. The free coloring agent adheres to the toner surfaces, and if carbon black is used as the coloring agent, the toner has a higher electrical conductivity in those parts thereof to which carbon black adheres, and the chargeability of the toner varies with the environment and its variation brings about undesirable results including a defective transfer.

SUMMARY OF THE INVENTION

Under these circumstances, it is an object of this invention to provide an improved toner used for developing an electrostatic latent image and having excellent properties including chargeability, transferability and resistance to dependence on environment.

It is another object of this invention to provide a method for producing an improved toner.

It is still another object of this invention to provide an improved developer for developing an electrostatic latent image.

It is a further object of this invention to provide a method for forming an image.

These objects are attained by:

(1) A toner containing a binder resin and carbon black particles and used for developing an electrostatic latent image, wherein the carbon black particles adhering to the toner surfaces has an ultraviolet absorption of 0.250 or less at 600 nm, the toner having a volume-average particle diameter of 2.0 to 9.0 micron, and a volume-average particle size distribution index, GSDv $(D_{84V}/D_{16V})^{1/2}$, of 1.25 or less;

(2) The toner as set forth at (1) above, wherein the toner has an outermost resin layer on the surface of its toner particles;

(3) The toner as set forth at (1) above, wherein the toner contains a mold release agent;

(4) The toner as set forth at (1) above, wherein the toner has an average shape factor (the square of maximum length/projected area=$ML^2/A$) of 105 to 140;

(5) The toner as set forth at (1) above, wherein the toner has a chargeability of −40 to −10 $\mu$C/g;

(6) A method for producing a toner as set forth at (1) above, which includes the steps of mixing dispersion of resin particles and dispersion of carbon black particles, coagulating of these particles, and heating the particles to melt and unite them to obtain toner particles;

(7) The method for producing a toner as set forth at (6) above, further including the step of adding dispersion of resin particles to adhere to the surfaces of the coagulated particles before heating the particles;

(8) The method as set forth at (7) above, wherein said dispersion added in amount occupies 12 to 50% by solid weight of dispersion containing the coagulated particles;

(9) The method as set forth at (6) above, wherein the coagulating is effected by adding a surface active agent having opposite polarity to a surface active agent which is contained in the dispersion of resin particles and/or dispersion of carbon black particles;

(10) The method as set forth at (6) above, wherein the coagulating is effected by adding a metal compound as a coagulating agent to mixture of the dispersion;

(11) The method as set forth at (6) above, wherein the mixture of dispersion uses a water or an organic solvent as a dispersant;

(12) The method as set forth at (6) above, wherein dispersion of resin particles and/or dispersion of carbon black particles contain a mold release agent;

(13) The method as set forth at (6) above, wherein the resin particles have an average dispersion diameter, $d_{50}$, of one micron or less;

(14) The method as set forth at (6) above, wherein the carbon black particles have an average dispersion diameter, $d_{50}$, of 100 to 500 nm;

(15) The method as set forth at (14) above, wherein the carbon black particles have a volume-cumulative diameter, $d_{84}$, of 400 nm or less;

(16) The method as set forth at (15) above, wherein dispersion of carbon black particles does not contain any carbon black particle having a dispersion diameter exceeding 500 nm;

(17) A developer for developing an electrostatic latent image, which contains a carrier and a toner, wherein a toner as set forth at (1) above is used as the toner;

(18) The developer as set forth at (17) above, wherein the carrier has a resin coat;

(19) A method for forming an image which includes the steps of forming an electrostatic latent image on a latent image support member, developing the latent image with a developer to form a toner image, and transferring the toner image onto a support member, wherein a developer as set forth at (17) above isused;

(20) The method as set forth at (19) above,further includes the step of cleaning the latent image support member for removing any toner therefrom; and

(21) The method as set forth at (19) above, wherein the removed toner is used again for forming a toner image.

The toner of this invention has, among others, excellent chargeability, transferability and resistance to influence by environmental factors owing to the restriction of the amount of free carbon black present on the surfaces of its particles.

DETAILED DESCRIPTION OF THE INVENTION

We have found a specific relationship between the amount of free carbon black adhering to the surfaces of toner particles and the properties of the toner, particularly its chargeability, transferability and resistance to influence by environmental factors, and succeeded in realizing a toner having excellent chargeability, transferability and resistance to influence by environmental factors by restricting the amount of any such carbon black to or below a specific level.

According to this invention, the excellent properties as stated above are attained by a toner comprising a resin and carbon black, and having a volume-average particle diameter, $D_{50}$, of 2.0 to 9.0 microns and a volume-average particle size distribution index, GSDv $(D_{84V}/D_{16V})^{1/2}$, of 1.25 or less, wherein carbon black adhering to the toner surfaces has an ultraviolet absorption of 0.250 or less at 600 nm. If the amount of the free carbon black is so that it has an ultraviolet absorption of over 0.250, the toner does not exhibit any desired chargeability, transferability, or resistance to influence by environmental factors. Its preferred ultraviolet absorption is from 0.001 to 0.250. This invention does not cover any capsulated toner.

The ultraviolet absorption (or ABS value) of carbon black as employed for defining the invention was determined as stated below:

(1) One part by weight of a toner is placed in a sample bottle with 90 parts by weight of ion-exchange water and 0.5 part by weight of a surface active agent (Triton×100);

(2) The toner is ultrasonically cleaned for an hour;

(3) The toner is separated by a centrifugal separator operating at 5000 rpm for five minutes;

(4) The supernatant in the bottle is collected by a pipette; and (5) The supernatant is analyzed by a spectrophotometer (of Hitachi, Limited) for its absorption of ultraviolet radiation having a wavelength of 600 nm.

The toner of this invention has a volume-average particle diameter, $D_{50}$, of from 2 to 9 micron, and preferably from 3 to 8 micron. If its $D_{50}$ exceeds 9 micron, the toner may have a lower power of reproducing a photographic image, or thin lines without being able to develop any latent image in dots or lines faithfully. If its $D_{50}$ is smaller than 2 micron, the toner has so large a surface area per unit weight that its chargeability and flowability may be too difficult to control for making any stable picture.

The toner of this invention has a volume-average particle size distribution index, GSDv $(D_{84V}/D_{16V})^{1/2}$, of 1.25 or less, and preferably 1.23 or less. If this value exceeds 1.25, it is impossible to obtain both a high picture quality and a high reliability at the same time. More particularly, the developer has a shorter life and a lower ability to produce distinct images. It has a lower developing power, as it is likely to cause selective development.

The volume-average particle diameter of the toner can be measured by using an instrument, such as a Coulter counter TA-II (of Nikkaki Co.), or a Multisizer II (of Nikkaki Co.). The volume-average particle diameter $D_{50}$ is the particle diameter at which particles of smaller diameters have a total volume of 50%, and the volume-average particle size distribution index GSDv is the square root of ratio of the particle diameter $D_{84V}$at which particles of smaller diameters have a total volume of 84%, to the particle diameter $D_{16V}$ at which particles of smaller diameters have a total volume of 16%.

The toner of this invention has an average shape factor of from 105 to 140, and preferably from 105 to 130. If it exceeds 140, the toner may have a lower ability to form images and a lower productivity. The shape factor $(ML^2/A)$ is the percentage obtained by dividing the projected area of a true sphere having a diameter equal to the maximum length ML of the toner particles by the real projected area A of the toner particles, and calculated by the equation:

$$ML^2/A=[(\text{Maximum length}/2)^2\times\pi\times100]\div(\text{Real projected area})$$

The average shape factor of the toner is obtained by recording the images of toner particles spread on a glass slide by a video camera through the screen of an optical microscope, inputting them into a Luzex image analyzer, measuring the maximum length ML of each of at least 100 toner particles and the real projected area A thereof, calculating the shape factor thereof by the above equation, and obtaining the average of the shape factors of those particles.

As a true sphere has a shape factor $(ML^2/A)$ of 100, the toner particles having an average shape factor closer to 100 are closer to true spheres, while those having an average shape factor larger than 100 have a flattened, or irregular shape.

The toner of this invention may be produced by any process if it satisfies the requirements described above as to the shape and diameter of its particles and the amount of free carbon black remaining thereon. It can be produced by, for example, (1) an emulsion polymerization and coagulation process in which dispersion of resin particles obtained by the emulsion polymerization of a binder resin as a polymerizable monomer is mixed with dispersion of carbon black particles, and optionally dispersion of e.g. a mold release agent, or antistatic controller, to form coagulated particles, and the coagulated particles are melted and united by heating to form toner particles, (2) a suspension polymerization process in which a binder resin as a polymerizable monomer and carbon black particles, as well as optionally a mold release agent, antistatic controller, etc., are suspended for polymerization in an aqueous solvent, (3) a particle coagulation process in which dispersions in an aqueous solvent of binding resin particles and carbon black particles, as well as optionally of a mold release agent, antistatic controller, etc., are mixed to form coagulated particles, and the coagulated particles are melted and united by heating to form toner particles. Dispersion of resin particles may further be added to dispersion of coagulated particles as obtained above to form outermost resin layers on the surfaces of the coagulated particles to impart a core and shell structure thereto. The outermost resin layers can effectively restrain the liberation of carbon black from the particle surfaces.

Dispersion of particles coagulated as described above is heated so that they may be melted and united, or sintered, and the sintered particles are washed to give toner particles. The heating temperature may range from the glass transition temperature of the outermost resin layers to below the decomposition temperature of the resin. By heating at any such temperature, it is possible to make particles having a properly controlled shape. A known apparatus can be used for such heating.

For washing the particles, it is appropriate to adjust the pH of their dispersion to a range of from 9.5 to 12.0, and preferably from 10.0 to 11.5, and wash it at a temperature of from 25° C. to 45° C., and preferably from 35° C. to 45° C., whereafter it is washed with ion-exchange water. If the dispersion has a pH below 9.5, it is likely that the surface active agent may not be extracted thoroughly, and that the toner may be of lower chargeability, or of lower stability at a high temperature. If its pH is over 12.0, the toner may contain some alkali, and may be unsatisfactory in chargeability. If the washing temperature is higher than 45° C., carbon black may be easily liberated from the toner particles, and if it is lower than 25° C., the surface active agent is more likely to remain in the toner particles.

In order to control the amount of free carbon black adhering to the toner surfaces as stated before, it is effective to, for example, use dispersion of carbon black particles in which the particles have an average diameter $d_{50}$ of from 100 to 300 nm, and preferably from 100 to 250 nm, while particles making a total volume of 84% have a diameter $d_{84}$ of 400 nm or less, and preferably 350 nm or less, and which does not contain any particle having a diameter over 500 nm. Carbon black particles having too large a diameter are hardly incorporated into the toner, but are easily liberated. Carbon black particles having too small a diameter have so low a coloring power that it is necessary to increase the amount of their dispersion which is used. Its increase, however, not only brings about an increase of free carbon black, but also has an adverse effect on the shape of the toner particles. The diameters of the carbon black particles in their dispersion were measured through a scanning electron microscope (SEM).

Examples of the binder resin for the toner according to this invention are homopolymers of styrenes such as styrene and chlorostyrene, monoolefins such as ethylene, propylene, butylene and isoprene, vinyl esters such as vinyl acetate, vinyl propionate, vinyl benzoate and vinyl butyrate, α-methylene aliphatic monocarxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropenyl ketone, and copolymers thereof.

Typical binder resins are, for example, polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. Other examples are polyesters, polyurethanes, an epoxy resin, a silicone resin, polyamides, modified rosin and paraffin wax. Vinyl resins are, among others, preferred.

If a vinyl monomer is used as a binder resin, it is advantageously possible to produce dispersion of resin particles by emulsion or seed polymerization using an ionic surface active agent, etc. Dispersion of particles of any other resin may be produced by dissolving the resin in an oily solvent having a relatively low solubility in water, dispersing the resin particles in water with an ionic surface active agent and a high molecular electrolyte in a dispersing machine such as a homogenizer, and evaporating the solvent under heat and/or at a reduced pressure.

The resin particles have an average diameter $d_{50}$ of one micron or less, and preferably from 0.01 to one micron, in their dispersion. If it exceeds one micron, there will be obtained a toner of low quality and reliability having an undesirably broad particle size distribution, or containing free resin particles. The average diameter $d_{50}$ is the particles diameter at which particles of smaller diameters make a total volume of 50%, as measured through a SEM.

Carbon black is used as a coloring agent for the toner according to this invention, though another coloring agent can be added to obtain any desired color, or physical properties.

The toner of this invention may further contain a mold release agent. It is generally desirable to use a mold release agent having a low compatibility with the binder resin. Specific examples of substances which can be used as the mold release agent are low-molecular polyolefins such as polyethylene, polypropylene and polybutene, silicones exhibiting a softening point under heat, fatty acid amides such as oleic amide, erucic amide, ricinoleic acid amide and stearic acid amide, vegetable waxes such as carnauba wax, rice wax, candelilla wax, Japan wax and jojoba oil, animal waxes such as bees' wax, mineral and petroleum waxes such as montan wax, ozokerite, ceresine, paraffin wax, microcrystalline wax and Fischer-Tropsch wax, ester waxes formed from higher fatty acids and higher alcohols, such as stearyl stearate and behenyl behenate, ester waxes formed from higher fatty acids and monovalent orpolyvalent lower alcohols, such as butyl stearate, propyl oleate, monostearic acid glyceride, distearic acid glyceride and pentaerythritol tetrabehenate, ester waxes formed from higher fatty acids and polyol polymers, such as diethylene glycol monostearate, dipropylene glycol distearate, distearic acid diglyceride and tetrastearic acid triglyceride, sorbitan higher fatty acid ester waxes such as sorbitan monostearate, and cholesterol higher fatty acid ester waxes such as cholesteryl stearate. It is also possible to use two or more such substances together.

The toner may also contain anantistatic agent. Any known antistatic agent can be used. Examples are an azo-metal complex compound, a salicylic acid-metal complex compound and an antistatic agent of the resin type containing a polar group. If the toner is produced by a wet process, it is desirable to use an antistatic agent which is hardly soluble in water, so that it may be possible to control its ionic strength and prevent the contamination of waste water.

The toner may further contain, for example, a low-molecular polypropylene or polyethylene wax as an offset inhibitor.

The toner of this invention may be a magnetic toner containing a magnetic material, or a non-magnetic one not containing any magnetic material.

An aqueous solvent may be used as a medium for dispersion of resin particles, dispersion of carbon black particles, and dispersion of other particles, if any. Examples are distilled water, ion-exchange water and alcohols. It is also possible to use two or more substances together.

This invention is carried out by employing a surface active agent for various purposes including the preparation of resin particles by emulsion polymerization, the stabilization of dispersion of any of resin particles, a coloring agent and a mold release agent, the promotion of coagulation of particles and the stabilization of coagulated particles. It is possible to use any of anionic surface active agents such as sulfates, sulfonates, phosphates and soaps, cationic surface active agents such as amine salts and tertiary ammonium salts, and nonionic surface active agents such as polyethylene glycol, alkylphenol ethylene oxide adducts and polyhydric alcohols, or a combination thereof. A common dispersing machine having a rotary shearing homogenizer or medium, such as a ball, sand mill or Dynomill can be used for any such dispersion.

A coagulating agent, such as a metal compound, or a polymer thereof, can be used instead of an ionic surface active agent for coagulating resin or carbon black particles when producing the toner of this invention. The use of a coagulating agent having a high coagulating power is effective for decreasing the amount of free carbon black remaining on the toner surfaces. The coagulating agent is used in the amount of from 0.05 to 0.30%, and preferably from 0.10 to 0.25%, by weight relative to dispersion of particles in a coagulating system. A metal compound, or a polymer thereof is used by dissolving in dispersion of fine resin particles. The metal compound is of a metal element belonging to Group 2A, 3A, 4A, 5A, 6A, 7A, 8, 1B, 2B or 3B, having an electric charge of two or more units, and soluble in ion form in a coagulating system for resin particles. Specific examples are metal compounds such as calcium chloride, calcium nitrate, barium chloride, magnesium chloride, zinc chloride, aluminum chloride and aluminum nitrate, and polymers of metal compounds such as poly (aluminum chloride), poly(aluminum hydroxide) and poly (calcium sulfide).

According to a further aspect of this invention, dispersion of resin particles is added after the coagulation of resin and carbon black particles, and other particles, if any, to cause resin particles to adhere to the surfaces of coagulated particles, and the whole is melted and united under heat to form toner particles having outermost surface layers, or shells. The shells effectively restrain any carbon black, mold release agent, etc. from being exposed on the surfaces of toner particles. The dispersion of resin particles may be added in the amount of from 12 to 50%, and preferably from 12 to 25%, by solid weight relative to dispersion of coagulated particles. If its amount exceeds 50%, resin particles may not adhere to the coagulated particles satisfactorily, but may give a toner having an undesirably high volume-average particle size distribution index, GSDv. If it is smaller than 12%, resin particles may not cover the whole surfaces of toner particles, but may allow the toner particles to carry an undesirably large amount of free carbon black.

The inorganic particles to be used for the purpose of this invention may be of, for example, silica, alumina, titania, calcium carbonate, magnesium carbonate, calcium phosphate or cerium oxide. Known surface treatment may be given to those particles.

The toner of this invention has an electric charge of from −40 $\mu$C/g to −10 $\mu$C/g, and preferably from −35 $\mu$C/g to −15 $\mu$C/g. If its charge exceeds −10 $\mu$C/g, background staining (or fogging) is likely to occur, and if it is smaller than −40 $\mu$C/g, a lowering of image density is likely to occur. The toner preferably has an environmental dependence index of from 0.5 to 1.5, and more preferably from 0.7 to 1.3, which is the ratio of its electric charge in an environment of low temperature and humidity (10° C. and 15% RH) to that in an environment of high temperature and humidity (28° C. and 85% RH). A higher or lower ratio indicates that the toner is so greatly dependent on its environment that a problem is likely to occur in use.

The carrier to be used for the purpose of this invention is not specifically limited, but may, for example, be a resin-coated carrier having a resin coating layer on a core. The core of such a carrier may be formed from a matrix resin containing a conductive powder, etc. dispersed therein.

Examples of the coating and matrix resins for the carrier are polyethylene, polypropylene, polystyrene, polyacrylonirile, polyvinyl acetate, polyvinyl alcohol, polyvinyl butyral, polyvinyl chloride, polyvinyl carbazole, polyvinyl ether, polyvinyl ketone, a vinyl chloride-vinyl acetatecopolymer, astyrene-acrylicacidcopolymer, astraight silicone resin composed of an organosiloxane bond, ora-modified product thereof, a fluororesin, polyester, polyurethane, polycarbonate, a phenolic resin, an amino resin, a melamine resin, a benzoguanamine resin, a urea resin, an amide resin and an epoxy resin.

The core maybe formed from, for example, amagnetic metal such as iron, nickel or cobalt, a magnetic oxide such as ferrite or magnetite, or glass beads, but is preferably of a magnetic material so that the carrier may have its volume resistivity controlled appropriately for the toner to be used in a magnetic brush process. The core may have an average particle diameter of from 10 to 500 micron, and preferably from 30 to 100 micron.

It is possible to control the volume resistivity of the carrier by adding an electrically conductive material to its coating layers. Examples of the conductive materials which can be used are metals such as gold, silver and copper, carbon black, titanium oxide, zinc oxide, barium sulfate, aluminum borate, potassium titanate and tin oxide.

The cores of the carrier can be coated with a resin by, for example, dipping them in a solution of the resin, spraying the solution onto the core surfaces, spraying the solution onto the cores floating in a stream of air, or mixing the cores with the solution in a kneader coater and removing the solvent.

The toner and carrier as described above are mixed in appropriate proportions to provide a developer for developing an electrostatic latent image according to this invention. According to this invention, there is also provided a method for forming an image, wherein an electrostatic latent image is formed on its support member, and developed by a developer held on its support member. An electrostatic latent image is formed by a known method on its support which may, for example, be an electrophotographic sensitive material, or a dielectric recording medium. The support member for a developer may, for example, be a rotatable non-magnetic sleeve containing a stationary magnetic roll therein, and is positioned opposite to the support for an electrostatic latent image support member. A toner image formed on the latter support is transferred, and fixed by a heated roll. The toner remaining on the latent image support member after the transfer of a toner image may be collected by cleaning it, and supplied to the developing apparatus for reuse. Alternatively, the latent support member may not be cleaned as stated, but the toner may be recovered by use during another developing job.

EXAMPLES

The invention will now be described more specifically based on several examples embodying it, though the following description is not intended for limiting the scope of this invention.

Preparation of Dispersion 1 of Resin Particles:

Styrene—370 parts by weight n-Butyl acrylate—30 parts by weight

Acrylic acid—8 parts by weight

Dodecanethiol—24 parts by weight

Carbon tetrabromide—4 parts by weight

A solution is produced by mixing the above components, X and put in a flask containing 6 parts by weight of a nonionic surface active agent (Nonipol 400 of Sanyo Chemical Co., Ltd.) and 10 parts by weight of an anionic surface active agent (Neogen SC of Daiichi Kogyo Seiyaku Co., Ltd.) as dissolves in 550 parts by weight of ion-exchange water to form an emulsion. While it is slowly mixed for 10 minutes, the flask is fed with 50 parts by weight of ion-exchange water containing 4 parts by weight of ammonium persulfate dissolved therein for nitrogen purging. Then, the flask is heated in an oil bath under stirring until its contents have a temperature of 70° C., and they are left to continue emulsion polymerization for five hours. As a result, there is obtained dispersion 1 of resin particles having a Tg of 59° C., a weight-average molecular weight (Mw) of 12,000 and an average diameter $d_{50}$ of 155 nm.

Preparation of Dispersion 2 of Resin Particles:

Styrene—280 parts by weight n-Butyl acrylate—120 parts by weight

Acrylic acid—8 parts by weight

A solution is produced by mixing the above components, and put in a flask containing 6 parts by weight of a nonionic surface active agent (Nonipol 400 of Sanyo Chemical Co., Ltd.) and 12 parts by weight of an anionic surface active agent (Neogen SC of Daiichi Kogyo Seiyaku Co., Ltd.) as dissolves in 550 parts by weight of ion-exchange water to form an emulsion. While it is slowly mixed for 10 minutes, the flask is fed with 50 parts by weight of ion-exchange water containing 3 parts by weight of ammonium persulfate dissolved therein for nitrogen purging. Then, the flask is heated in an oil bath under stirring until its contents have a temperature of 70° C., and they are left to continue emulsion polymerization for five hours. As a result, there is obtained dispersion 2 of resin particles having a Tg of 53° C., a weight-average molecular weight (Mw) of 550,000 and an average diameter $d_{50}$ of 105 nm.

Preparation of Dispersion 3 of Resin Particles:

Styrene—360 parts by weight n-Butyl acrylate—40 parts by weight

Methacrylic acid—6 parts by weight

A solution is produced by mixing the above components, and put in a flask containing 8 parts by weight of a nonionic surface active agent (Nonipol 400 of Sanyo Chemical Co., Ltd.) and 15 parts by weight of an anionic surface active agent (Neogen R of Daiichi Kogyo Seiyaku Co., Ltd.) as dissolves in 660 parts by weight of ion-exchange water to form an emulsion. While it is slowly mixed for 10 minutes, the flask is fed with 50 parts by weight of ion-exchange water containing 3 parts by weight of ammonium persulfate dissolved therein for nitrogen purging. Then, the flask is heated in an oil bath under stirring until its contents have a temperature of 70° C., and they are left to continue emulsion polymerization for five hours. As a result, there is obtained dispersion 3 of resin particles having a Tg of 58° C., a weight-average molecular weight (Mw) of 33,000 and an average diameter $d_{50}$ of 165 nm.

Preparation of Dispersion 1 of Carbon Black Particles:

Carbon black (Mogal L of Cabot Co.)—50 parts by weight

Anionic surface active agent (Neogen R of Daiichi Kogyo Seiyaku Co., Ltd.)—2 parts by weight Ion-exchange water—200 parts by weight Dispersion 1 of carbon black particles having an average diameter $d_{50}$of 160 nm and a diameter $d_{84}$ of 280 nm (of particles making a total volume of 84%), and not containing any particle having a diameter of 500 nm or larger is produced by mixing the above components for 20 minutes in a homogenizer (ULTRA-TURRAX T50 of IKA).

Preparation of Dispersion 2 of Carbon Black Particles:

Carbon black (Mogal L of Cabot Co.)—50 parts by weight

Anionic surface active agent (Neogen R of Daiichi Kogyo Seiyaku Co., Ltd.)—2 parts by weight Ion-exchange water—200 parts by weight Dispersion 2 of carbon black particles having an average diameter $d_{50}$ of 450 nm and a diameter d84 of 530 nm (of particles making a total volume of 84%), and not containing any particle having a diameter of 500 nm or larger is produced by mixing the above components for five minutes in a homogenizer (ULTRA-TURRAX T50 of IKA).

Preparation of Dispersion 3 of Carbon Black Particles:

Carbon black (BPL of Cabot Co.)—50 parts by weight

High-molecular dispersing agent for pigments (Solsperse of ICI)—5 parts by weight Ion-exchange water—200 parts by weight Dispersion 3 of carbon black particles having an average diameter $d_{50}$ of 200 nm and a diameter $d8_4$ of 280 nm (of particles making a total volume of 84%), and not containing any particle having a diameter of 500 nm or larger is produced by mixing the above components for 15 minutes in a homogenizer (ULTRA-TURRAX T50 of IKA).

Preparation of Dispersion 4 of Carbon Black Particles:

Carbon black (BPL of Cabot Co.)—50 parts by weight

High-molecular dispersing agent for pigments (Solsperse of ICI)—1.5 parts by weight Ion-exchange water—200 parts by weight Dispersion 4 of carbon black particles having an average diameter $d_{50}$ of 450 nm and a diameter $d_{84}$ of 500 nm (of particles making a total volume of 84%), and not containing any particle having a diameter of 500 nm or larger is produced by mixing the above components for five minutes in a homogenizer (ULTRA-TURRAX T50 of IKA).

Preparation of Dispersion 1 of a Mold Release Agent:

Paraffin wax (HNP0190 of Nippon Seiro Co, Ltd. having a melting point of 85° C.)—50 parts by weight Anionic surface active agent (Neogen SC of Daiichi Kogyo Seiyaku Co., Ltd.)—10 parts by weight Ion-exchange water—240 parts by weight Dispersion 1 of particles of a mold release agent having an average diameter $d_{50}$ of 200 nm is produced by heating the above components to 95° C., and subjecting them to dispersion treatment in a homogenizer (ULTRA-TURRAX T50 of IKA) and then in a pressure discharge type homogenizer.

Preparation of Dispersion 2 of a Mold Release Agent:

Paraffin wax (100P of Mitsui Petrochemical Co, Ltd.)—50 parts by weight

Anionic surface active agent (Neogen SC of Daiichi Kogyo Seiyaku Co., Ltd.)—10 parts by weight Ion-exchange water—240 parts by weight Dispersion 2 of particles of a mold release agent having an average diameter $d_{50}$ of 190 nm is produced by heating the above components to 95° C., and subjecting them to dispersion treatment in a homogenizer (ULTRA-TURRAX T50 of IKA) and then in a pressure discharge type homogenizer.

Example 1

Preparation of Coagulated Particles:

Dispersion 3 of resin particles—200 parts by weight

Dispersion 1 of carbon black particles—200 parts by weight

Dispersion 1 of a mold release agent—40 parts by weight

Poly(aluminum hydroxide) (of Asada Chemical Co.)—0.125 part by weight

Dispersion of coagulated particles is produced by mixing the above components in a round stainless steel flask by a homogenizer (ULTRA-TURRAX T50 of IKA), heating the mixture to 55° C. in the flask under stirring in an oil bath and holding it at that temperature for 20 min. The coagulated particles have an average diameter $d_{50}$ of about 4.8 micron as determined through an optical microscope.

Preparation of Resin-Coated Coagulated Particles:

Dispersion of resin-coated coagulated particles is produced by adding 50 parts by weight of dispersion 3 of resin particles slowly to the dispersion of coagulated particles and holding the mixture for 60 min. to allow resin particles to adhere to the surfaces of the coagulated particles. The resin-coated particles have an average diameter $d_{50}$ of about 5.0 micron as determined through an optical microscope. The dispersion 3 of resin particles containes 20% by solid weight of resin particles relative to the dispersion of coagulated particles.

Melting and Uniting under Heat:

After 3 parts by weight of an anionic surface active agent (Neogen SC of Daiichi Kogyo Seiyaku Co., Ltd.) has been added to the dispersion, the flask is closed, and its contents are heated to 95° C., and hold at that temperature for six hours under stirring by a magnetic seal. The reaction product is cooled and collected by filtration, and after having its pH adjusts to 11.5 and being washed at 40° C., it is further washed thoroughly with ion-exchange water, and dries to yield toner particles. The toner particles have an average diameter $D_{50}$ of 4.8 micron, an $ML^2/A$ of 130, a GSDv of 1.20, and an ABS value of 0.015 showing the amount of free carbon black on their surfaces. A black toner is obtained by adding 0.65% by weight of silica (R972 of Nippon Aerosil Co.) to the toner particles and mixing them in a Henschel mixer.

Example 2

Preparation of Coagulated Particles:

Dispersion 1 of resin particles—120 parts by weight

Dispersion 2 of resin particles—80 parts by weight

Dispersion 1 of carbon black particles—200 parts by weight

Dispersion 2 of a mold release agent—40 parts by weight

Poly(aluminum hydroxide) (of Asada Chemical Co.)—0.14 part by weight

Dispersion of coagulated particles is produced by mixing the above components in a round stainless steel flask by a homogenizer (ULTRA-TURRAX T50 of IKA), heating the mixture to 58° C. in the flask under stirring in an oil bath and holding it at that temperature for 60 min. The coagulated particles have an average diameter $d_{50}$ of about 5.5 micron as determined through an optical microscope.

Preparation of Resin-Coated Coagulated Particles:

Dispersion of resin-coated coagulated particles is produced by adding 33 parts by weight of dispersion 1 of resin particles slowly to the dispersion of coagulated particles and holding the mixture for 60 min. to allow resin particles to adhere to the surfaces of the coagulated particles. The resin-coated particles have an average diameter $d_{50}$ of about 5.8 micron as determined through an optical microscope. Dispersion 1 of resin particles contains 14% by solid weight of resin particles relative to the dispersion of coagulated particles.

Melting and Uniting under Heat:

After 3 parts by weight of an anionic surface active agent (Neogen SC of Daiichi Kogyo Seiyaku Co., Ltd.) has been added to the dispersion, the flask is closed, and its contents are heated to 95° C., and held at that temperature for six hours under stirring by a magnetic seal. The contents are then cooled and the reaction products are collected by filtration, and after having pH of the contents adjusted to 10.5 and being washed at 25° C., the contents are further washed thoroughly with ion-exchange water, and dried to yield toner particles. The toner particles have an average diameter $D_{50}$ of 5.6 micron, an $ML^2/A$ of 128, a GSDv of 1.21, and an ABS value of 0.040 showing the amount of free carbon black on their surfaces. A black toner is obtained by adding 0.65% by weight of silica (R972 of Nippon Aerosil Co.) to the toner particles and mixing them in a Henschel mixer.

Example 3

Preparation of Coagulated Particles:

Dispersion 3 of resin particles—200 parts by weight

Dispersion 3 of carbon black particles—200 parts by weight

Cationic surface active agent (Sanisol B50 of Kao Corp.)—1.5 parts by weight

Dispersion of coagulated particles is produced by mixing the above components in a round stainless steel flask by a homogenizer (ULTRA-TURRAX T50 of IKA), heating the mixture to 55° C. in the flask under stirring in an oil bath and holding it at that temperature for 20 min. The coagulated particles have an average diameter $d_{50}$ of about 5.0 micron as determined through an optical microscope.

Preparation of Resin-Coated Coagulated Particles:

Dispersion of resin-coated coagulated particles is produced by adding 50 parts by weight of dispersion 3 of resin particles slowly to the dispersion of coagulated particles and holding the mixture for 60 min. to allow resin particles to adhere to the surfaces of the coagulated particles. The resin-coated particles have an average diameter $d_{50}$ of about 5.1 micron as determined through an optical microscope. Dispersion 3 of resin particles contains 20% by solid weight of resin particles relative to the dispersion of coagulated particles.

Melting and Uniting under Heat:

After 3 parts by weight of an anionic surface active agent (Neogen SC of Daiichi Kogyo Seiyaku Co., Ltd.) has been added to the dispersion, the flask is closed, and its contents are heated to 97° C., and held at that temperature for six hours under stirring by a magnetic seal. The contents are then cooled and the reaction products are collected by filtration, and after having pH adjusted to 12.0 and being washed at 25° C., the contents are further washed thoroughly with ion-exchange water, and dried to yield toner particles. The toner particles have an average diameter $D_{50}$ of 5.2 micron, an $ML^2/A$ of 120, a GSDv of 1.23, and an ABS value of 0.220 showing the amount of free carbon black on their surfaces. A black toner is obtained by adding 0.65% by weight of silica (R972 of Nippon Aerosil Co.) to the toner particles and mixing them in a Henschel mixer.

Example 4

Preparation of Coagulated Particles:

Dispersion 1 of resin particles—120 parts by weight

Dispersion 2 of resin particles—80 parts by weight

Dispersion 3 of carbon black particles—200 parts by weight

Dispersion 1 of a mold release agent—40 parts by weight

Iron hydroxide—1.5 parts by weight

Dispersion of coagulated particles is produced by mixing the above components in a round stainless steel flask by a homogenizer (ULTRA-TURRAX T50 of IKA), heating the mixture to 60° C. in the flask under stirring in an oil bath and holding it at that temperature for 20 min. The coagulated particles have an average diameter $d_{50}$ of about 6.5 micron as determined through an optical microscope.

Preparation of Resin-Coated Coagulated Particles:

Dispersion of resin-coated coagulated particles is produced by adding 40 parts by weight of dispersion 1 of resin particles slowly to the dispersion of coagulated particles and holding the mixture for 60 min. to allow resin particles to adhere to the surfaces of the coagulated particles. The resin-coated particles have an average diameter $d_{50}$ of about 6.5 micron as determined through an optical microscope. Dispersion 1 of resin particles contains 16% by solid weight of resin particles relative to the dispersion of coagulated particles.

Melting and Uniting under Heat:

After 3 parts by weight of an anionic surface active agent (Neogen SC of Daiichi Kogyo Seiyaku Co., Ltd.) has been added to the dispersion, the flask is closed, and its contents are heated to 93° C., and held at that temperature for six hours under stirring by a magnetic seal. The contents are then cooled and the reaction products are collected by filtration, and after having pH adjusted to 11.0 and being washed at 25° C., the contents are further washed thoroughly with ion-exchange water, and dried to yield toner particles. The toner particles have an average diameter $D_{50}$ of 6.5 micron, an $ML^2/A$ of 135, a GSDv of 1.22, and an ABS value of 0.180 showing the amount of free carbon black on their surfaces. A black toner is obtained by adding 0.65% by weight of silica (R972 of Nippon Aerosil Co.) to the toner particles and mixing them in a Henschel mixer.

Example 5

Preparation of Coagulated Particles:

Dispersion 3 of resin particles—180 parts by weight

Dispersion 1 of carbon black particles—200 parts by weight

Dispersion 2 of a mold release agent—40 parts by weight

Cationic surface active agent (Sanisol B50 of Kao Corp.)—1.5 parts by weight

Dispersion of coagulated particles is produced by mixing the above components in a round stainless steel flask by a homogenizer (ULTRA-TURRAX T50 of IKA), heating the mixture to 55° C. in the flask under stirring in an oil bath and holding it at that temperature for 20 min. The coagulated particles have an average diameter $d_{50}$ of about 5.0 micron as determined through an optical microscope.

Preparation of Resin-Coated Coagulated Particles:

Dispersion of resin-coated coagulated particles is produced by adding 120 parts by weight of dispersion 3 of resin particles slowly to the dispersion of coagulated particles and holding the mixture for 60 min. to allow resin particles to adhere to the surfaces of the coagulated particles. The resin-coated particles have an average diameter $d_{50}$ of about 5.2 micron as determined through an optical microscope. The dispersion 3 of resin particles containes 40% by solid weight of resin particles relative to the dispersion of coagulated particles.

Melting and Uniting under Heat:

After 3 parts by weight of an anionic surface active agent (Neogen SC of Daiichi Kogyo Seiyaku Co., Ltd.) has been added to the dispersion, the flask is closed, and its contents are heated to 95° C., and held at that temperature for six hours under stirring by a magnetic seal. The contents are then cooled and the reaction products are collected by filtration, and after having pH adjusted to 12.0 and being washed at 35° C., the contents are further washed thoroughly with ion-exchange water, and dried to yield toner particles. The toner particles have an average diameter $D_{50}$ of 5.3 micron, an $ML^{2/}A$ of 130, a GSDv of 1.21, and an ABS value of 0.010 showing the amount of free carbon black on their surfaces. A black toner is obtained by adding 0.65% by weight of silica (R972 of Nippon Aerosil Co.) to the toner particles and mixing them in a Henschel mixer.

COMPARATIVE EXAMPLE 1

Preparation of Coagulated Particles:

Dispersion 1 of resin particles—120 parts by weight

Dispersion 2 of resin particles—80 parts by weight

Dispersion 2 of carbon black particles—200 parts by weight

Dispersion 2 of a mold release agent—40 parts by weight

Poly(aluminum hydroxide) (of Asada Chemical)—0.15 part by weight

Dispersion of coagulated particles is produced by mixing the above components in a round stainless steel flask by a homogenizer (ULTRA-TURRAX T50 of IKA), heating the mixture to 55° C. in the flask under stirring in an oil bath and holding it at that temperature for 20 min. The coagulated particles have an average diameter $d_{50}$ of about 5.0 micron as determined through an optical microscope.

Preparation of Resin-Coated Coagulated Particles:

Dispersion of resin-coated coagulated particles is produced by adding 22 parts by weight of dispersion 1 of resin particles slowly to the dispersion of coagulated particles and holding the mixture for 60 min. There sin-coated particles have an average diameter $d_{50}$ of about 5.1 micron as determined through an optical microscope. The dispersion 1 of resin particles contains 10% by solid weight of resin particles relative to the dispersion of coagulated particles.

Melting and Uniting under Heat:

After 3 parts by weight of an anionic surface active agent (Neogen SC of Daiichi Kogyo Seiyaku Co., Ltd.) has been added to the dispersion, the flask ias closed, and its contents are heated to 95° C., and held at that temperature for six hours under stirring by a magnetic seal. The contents are cooled and the reaction products are collected by filtration, and after having pH adjusted to 12.0 and being washed at 70° C., the contents are further washed thoroughly with ion-exchange water, and dried to yield toner particles. The toner particles have an average diameter $D_{50}$ of 5.3 micron, an $ML^2/A$ of 130, a GSDv of 1.22, and an ABS value of 0.420 showing the amount of free carbon black on their surfaces. A black toner is obtained by adding 0.65% by weight of silica (R972 of Nippon Aerosil Co.) to the toner particles and mixing them in a Henschel mixer.

COMPARATIVE EXAMPLE 2

Preparation of Coagulated Particles:

Dispersion 1 of resin particles—120 parts by weight

Dispersion 2 of resin particles—80 parts by weight

Dispersion 1 of carbon black particles—200 parts by weight

Cationic surface active agent (Sanisol B50 of Kao Corp.)—1.5 parts by weight

Dispersion of coagulated particles is produced by mixing the above components in a round stainless steel flask by a homogenizer (ULTRA-TURRAX T50 of IKA), heating the mixture to 58° C. in the flask under stirring in an oil bath. The coagulated particles have an average diameter $d_{50}$ of about 5.5 micron as determined through an optical microscope.

Melting and Uniting under Heat:

After 3 parts by weight of an anionic surface active agent (Neogen SC of Daiichi Kogyo Seiyaku Co., Ltd.) have been added to the dispersion, the flask is closed, and its contents are heated to 93° C., and held at that temperature for six hours under stirring by a magnetic seal. The contents are then cooled and the reaction products are collected by filtration, and after having pH adjusted to 12.0 and being washed at 35° C., the contents are further washed thoroughly with ion-exchange water, and dried to yield toner particles. The toner particles have an average diameter $D_{50}$ of 5.7 micron, an $ML^2/A$ of 135, a GSDv of 1.25, and an ABS value of 0.380 showing the amount of free carbon black on their surfaces. A black toner is obtained by adding 0.65% by weight of silica (R972 of Nippon Aerosil Co.) to the toner particles and mixing them in a Henschel mixer.

COMPARATIVE EXAMPLE 3

Preparation of Coagulated Particles:

Dispersion 3 of resin particles—200 parts by weight

Dispersion 4 of carbon black particles—200 parts by weight

Dispersion 2 of a mold release agent—40 parts by weight $Fe(OH)_3$—0.20 part by weight Dispersion of coagulated particles is produced by mixing the above components in a round stainless steel flask by a homogenizer (ULTRA-TURRAX T50 of IKA), heating the mixture to 58° C. in the flask under stirring in an oil bath. The coagulated particles have an average diameter $d_{50}$ of about 5.5 micron as determined through an optical microscope.

Preparation of Resin-Coated Coagulated Particles:

Dispersion of resin-coated coagulated particles is produced by adding 11 parts by weight of dispersion 3 of resin particles slowly to the dispersion of coagulated particles and holding the mixture for 60 min. The resin-coated particles have an average diameter $d_{50}$ of about 5.6 micron as determined through an optical microscope. The dispersion 3 of resin particles contains 5% by solid weight of resin particles relative to the dispersion of coagulated particles.

Melting and Uniting under Heat:

After 3 parts by weight of an anionic surface active agent (Neogen SC of Daiichi Kogyo Seiyaku Co., Ltd.) has been added to the dispersion, the flask is closed, and its contents are heated to 97° C., and held at that temperature for six hours under stirring by a magnetic seal. The contents are then cooled and the reaction products are collected by filtration, and after having pH adjusted to 11.5 and being washed at 25° C., the contents are further washed thoroughly with ion-exchange water, and dried to yield toner particles. The toner particles have an average diameter $D_{50}$ of 5.6 micron, an $ML^2/A$ of 120, a GSDv of 1.25, and an ABS value of 0.370 showing the amount of free carbon black on their surfaces. A black toner is obtained by adding 0.65% by weight of silica (R972 of Nippon Aerosil Co.) to the toner particles and mixing them in a Henschel mixer.

COMPARATIVE EXAMPLE 4

Preparation of Coagulated Particles:

Dispersion 3 of resin particles—200 parts by weight

Dispersion 3 of carbon black particles—200 parts by weight

Dispersion 1 of a mold release agent—40 parts by weight

Poly(aluminum hydroxide) (of Asada Chemical)—0.17 part by weight

Dispersion of coagulated particles is produced by mixing the above components in a round stainless steel flask by a homogenizer (ULTRA-TURRAX T50 of IKA), heating the mixture to 60° C. in the flask under stirring in an oil bath. The coagulated particles have an average diameter $d_{50}$ of about 5.8 micron as determined through an optical microscope.

Preparation of Resin-Coated Coagulated Particles:

Dispersion of resin-coated coagulated particles is produced by adding 50 parts by weight of dispersion 3 of resin particles slowly to the dispersion of coagulated particles and holding the mixture for 60 min. There sin-coated particles have an average diameter $d_{50}$ of about 6.0 micron as determined through an optical microscope. The dispersion 3 of resin particles contains 20% by solid weight of resin particles relative to the dispersion of coagulated particles.

Melting and Uniting under Heat:

After 3 parts by weight of an anionic surface active agent (Neogen SC of Daiichi Kogyo Seiyaku Co., Ltd.) has been added to the dispersion, the flask is closed, and its contents are heated to 95° C., and held at that temperature for six hours under stirring by a magnetic seal. The contents are then cooled and the reaction products are collected by filtration, and after having pH adjusted to 11.5 and being washed at 70° C., the contents are further washed thoroughly with ion-exchange water, and dried to yield toner particles. The toner particles have an average diameter $D_{50}$ of 6.3 micron, an $ML^2/A$ of 130, a GSDv of 1.22, and an ABS value of 0.400 showing the amount of free carbon black on their surfaces. A black toner is obtained by adding 0.65% by weight of silica (R972 of Nippon Aerosil Co.) to the toner particles and mixing them in a Henschel mixer.

Evaluation of the Toner:

Developing Property:

The toner to be evaluated is used for forming an image by a Fuji Xerox VIVACE 500 as remodeled, and the image is examined for its background staining (or fogging) as determined by the number of particles found in an area of 1 $mm^2$. The results are ranked in four grades as defined below, and are shown in Table 1 below.

Grade 1—No fogging is found (zero particle/$mm^2$);

Grade 2—Fogging is found, but only to an extent not presenting any practical problem (1 to 30 particles/$mm^2$);

Grade 3—Fogging is somewhat perceivable by visual inspection (31 to 100 particles/$mm^2$);

Grade 4—Fogging is clearly perceivable by visual inspection (over 100 particles/$mm^2$).

Chargeability and its Environmental Dependence:

The toner is left to stand for 12 hours in each of an environment having a temperature of 28° C. and a relative humidity of 85% and an environment having a temperature of 10° C. and a relative humidity of 15%, while no external additive is added thereto. Then, its electric charges are determined by using a blowoff tribo (of Toshiba Chemical Co.), and are shown in Table 1 with its environmental dependence (as represented by the ratio of its charge in an environment of low temperature and humidity to that in an environment of high temperature and humidity).

Dispersion of carbon black particles:

In Table 1, "○" means that the dispersion of carbon black particles as employed has an average particle diameter $d_{50}$ of 100 to 300 nm and a particle diameter $d_{84}$ of 400 nm or less, and does not contain particles having a diameter exceeding 500 nm, and "×" means that the dispersion is different.

Formation of the outermost resin layer:

The amount of resin particles in the dispersion as employed for forming the outermost resin layer is shown by its percentage by solid weight relative to the dispersion of coagulated particles.

Washing:

In Table 1, "○" means that the reaction product, or the dispersion of particles melted and united under heat had its pH adjusted to between 9.5 and 12.0, is stirred at a temperature of 25° C. to 45° C., and is further washed with ion-exchange water, and "×" means that different conditions were employed for washing.

3. The toner as set forth in claim 1, wherein said toner further contains a mold release agent.

4. The toner as set forth in claim 1, wherein said toner has an average shape factor (the square of maximum length/projected area=$ML^2/A$) of 105 to 140.

5. The toner as set forth in claim 1, wherein said toner has a chargeability of −40 to −10 $\mu$C/g.

6. A method for producing a toner as set forth in claim 1, comprising the steps of mixing dispersion of resin particles and dispersion of carbon black particles, coagulating said particles, and heating said particles to melt and unite them to form toner particles.

7. The method as set forth in claim 6, further comprising the step of adding dispersion of resin particles to cause resin particles to adhere to the surfaces of the coagulated particles before heating said particles.

TABLE 1

| | Dispersion of carbon black particles | Dispersion of resin particles as added relative to dispersion of coagulated particles | Washing of reaction product | Absorption of ultraviolet radiation at 600 nm by free carbon black (ABS) | Shape factor | Volume-average particle size distribution index (GSDv) |
|---|---|---|---|---|---|---|
| Example 1 | ○ | 20% | ○ | 0.015 | 130 | 1.20 |
| Example 2 | ○ | 14% | ○ | 0.040 | 128 | 1.21 |
| Example 3 | ○ | 20% | ○ | 0.220 | 120 | 1.23 |
| Example 4 | ○ | 16% | ○ | 0.180 | 135 | 1.22 |
| Example 5 | ○ | 40% | ○ | 0.010 | 130 | 1.21 |
| Comparative Example 1 | x | 10% | x | 0.420 | 130 | 1.22 |
| Comparative Example 2 | ○ | No addition | ○ | 0.380 | 135 | 1.25 |
| Comparative Example 3 | x | 5% | ○ | 0.370 | 120 | 1.25 |
| Comparative Example 4 | ○ | 20% | x | 0.400 | 130 | 1.22 |

| | Grade of fogging | Charge in environment of high temp. and high humidity ($\mu$C/g) | Charge in environment of low temp. and low humidity ($\mu$C/g) | Environmental dependence |
|---|---|---|---|---|
| Example 1 | 1 | −12.3 | −16.3 | 0.75 |
| Example 2 | 1 | −16.3 | −20.2 | 0.81 |
| Example 3 | 2 | −10.5 | −16.2 | 0.65 |
| Example 4 | 2 | −11.3 | −18.0 | 0.63 |
| Example 5 | 1 | −21.0 | −28.3 | 0.74 |
| Comparative Example 1 | 4 | −25.0 | −58.3 | 0.43 |
| Comparative Example 2 | 3 | −9.3 | −12.3 | 0.76 |
| Comparative Example 3 | 3 | −12.3 | −25.3 | 0.49 |
| Comparative Example 4 | 4 | −26.3 | −38.3 | 0.69 |

Table 1 confirms that the developing agent of this invention is superior in developing property (without fogging), chargeability and resistance to its environmental dependence.

What is claimed is:

1. A toner comprising a binder resin and carbon black particles, wherein the carbon black particles adhere to the surface of said toner, said toner having an ultraviolet absorption of 0.250 or less at 600 nm, said toner having a volume-average particle diameter of 2.0 to 9.0 microns.

2. The toner as set forth in claim 1, wherein said toner surface has an outermost resin layer.

8. The method as set forth in claim 7, wherein said dispersion is added in an amount occupying 12 to 50% by solid weight of a dispersion containing said coagulated particles.

9. The method as set forth in claim 6, wherein said coagulating is effected by adding a surface active agent having opposite polarity to a surface active agent which is contained in said dispersion of resin particles and/or said dispersion of carbon black particles.

10. The method as set forth in claim 6, wherein said coagulatiing is effected by adding a metal compound as a coagulating agent to the mixture of said dispersions.

11. The method as set forth in claim 6, wherein said dispersion of resin particles and/or said dispersion of carbon black particles contains a mold release agent.

12. The method as set forth in claim 6, wherein said resin particles have a volume average diameter of one micron or less.

13. The method as set forth in claim 6, wherein said carbon black particles have an average diameter of 100 to 500 nm.

14. The method as set forth in claim 13, wherein smaller particles occupying a total volume of 84% in said carbon black particles have a diameter, $d_{84}$, of 400 nm or less.

15. The method as set forth in claim 14, wherein said dispersion of carbon black particles consists solely of particles having a diameter of 500 nm or less.

16. A developer for an electrostatic latent image contains a carrier and a toner, wherein a toner as set forth in claim 1 is used as the toner.

17. The developer as set forth in claim 16, wherein said carrier has a resin coat.

18. A method for forming an image comprising the steps of forming an electrostatic latent image on a latent image support member, developing said latent image with a developer to form a toner image, and transferring said toner image onto a support member, wherein said developer as set forth in claim 17 is used.

19. The method as set forth in claim 18, further comprising the step of cleaning said latent image support member for removing any toner therefrom.

20. The method as set forth in claim 19, wherein said removed toner is used again for forming a toner image.

21. The toner of claim 1, wherein said toner has a volume-average particle size distribution index, $GSD_V$ $(D_{84V}/D_{16V})^{1/2}$, of 1.25 or less.

* * * * *